US009252531B2

(12) United States Patent
Guo et al.

(10) Patent No.: US 9,252,531 B2
(45) Date of Patent: Feb. 2, 2016

(54) ELECTRICAL CONNECTOR WITH MAGNETIC ELEMENT

(71) Applicant: FOXCONN INTERCONNECT TECHNOLOGY LIMITED, Grand Cayman (KY)

(72) Inventors: Hui-Gang Guo, Kunshan (CN); Huo-Xing Jin, Kunshan (CN); Chun-Sheng Li, Kunshan (CN); Tie-Bing Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/497,277

(22) Filed: Sep. 25, 2014

(65) Prior Publication Data

US 2015/0104959 A1 Apr. 16, 2015

(30) Foreign Application Priority Data

Oct. 12, 2013 (CN) ..... 2013 2 0628808

(51) Int. Cl.
*H01R 13/62* (2006.01)
*H01R 13/506* (2006.01)
*H01R 13/6581* (2011.01)

(52) U.S. Cl.
CPC ..... *H01R 13/6205* (2013.01); *H01R 13/506* (2013.01); *H01R 13/6581* (2013.01)

(58) Field of Classification Search
CPC ..... H01R 13/658; H01R 13/6581; H01R 13/6205
See application file for complete search history.

(56) References Cited

U.S. PATENT DOCUMENTS 5,909,100 A * 6/1999 Watanabe ..... H02J 7/025 320/108
7,497,693 B1 * 3/2009 Wu ..... H01R 13/2442 439/39
7,517,222 B2 4/2009 Apple
7,625,212 B2 * 12/2009 Du ..... H01R 13/6205 439/39
8,388,354 B1 * 3/2013 Lin ..... H01R 13/6205 439/39
8,770,986 B2 * 7/2014 Furness ..... H01R 13/6205 439/39
8,790,120 B2 * 7/2014 Wang ..... H01R 13/6205 439/39
8,894,420 B2 * 11/2014 Schichl ..... H01R 13/5841 439/39
9,004,924 B2 * 4/2015 Kuo ..... H01R 13/6205 439/188

(Continued)

*Primary Examiner* — Ross Gushi
(74) *Attorney, Agent, or Firm* — Wei Te Chung; Ming Chieh Chang

(57) ABSTRACT

An electrical connector comprises an insulative housing, a plurality of conductive terminals secured in the insulative housing, a metal shell shielding around the insulative housing and a magnetic element retained in the metal shell. The metal shell forms an accommodating room for receiving the magnetic element. The magnetic element has an outer surface and a recess defined on the outer surface. The metal shell has a retaining arm corresponding to the recess. The design of the recess and the retaining arm make a better retaining effectivity for the electrical connector.

20 Claims, 6 Drawing Sheets

(56) References Cited

U.S. PATENT DOCUMENTS 9,065,205 B2 * 6/2015 Gao ..... H01R 13/508 1/1
9,088,098 B2 * 7/2015 Hwang ..... H01R 13/6205 1/1
9,130,317 B2 * 9/2015 Wang ..... H01R 13/6683 1/1
2014/0087569 A1 * 3/2014 Lee ..... H01R 13/6205 439/39
2014/0113461 A1 * 4/2014 Kim ..... H01R 13/6205 439/39
2014/0342578 A1 * 11/2014 Qian ..... H01R 13/6205 439/38
2015/0044885 A1 * 2/2015 Schichl ..... H01R 13/5841 439/39
2015/0093920 A1 * 4/2015 Colantuono ..... H05K 3/3447 439/39
2015/0104959 A1 * 4/2015 Guo ..... H01R 13/506 439/39
2015/0111401 A1 * 4/2015 Guo ..... H01R 13/6596 439/95
2015/0244105 A1 * 8/2015 Peng ..... H01R 13/6205 439/39

* cited by examiner

ELECTRICAL CONNECTOR WITH MAGNETIC ELEMENT

BACKGROUND OF THE INVENTION

1. Field of the Invention

The present invention generally relates to an electrical connector, and more particularly to an electrical connector with magnetic element retained therein.

2. Description of Related Art

U.S. Pat. No. 7,517,222 discloses an electrical connector comprising an insulator, a plurality of conductive terminals accommodated in the insulator, a metal shell shielding around the insulator and a magnetic element retained in the insulator. The metal shell includes side walls and a rear end wall shielding around the insulator. The magnetic element with smooth surface is accommodated in the metal shell. The front face of the magnetic element is exposed from the shell so as to mate with a corresponding magnetic element of the complementary connector. Normally, the manner of securing the magnetic element of the electrical connector is using glue or adding additional retaining component. However, some of the manners have a poor assembly efficiency, and some of the manners have a poor retaining force.

In view of the foregoing, an electrical connector with at least a magnetic element firmly secured therein would be desirable.

SUMMARY OF THE INVENTION

Accordingly, an object of the present invention is to provide an electrical connector, which has at least one magnetic element firmly secured therein.

In order to achieve the object set forth, an electrical connector comprises an insulative housing, a plurality of conductive terminals secured in the insulative housing, a metal shell shielding around the insulative housing and a magnetic element retained in the metal shell. The metal shell forms an accommodating room for receiving the magnetic element. The magnetic element has an outer surface and a recess defined at the outer surface. The metal shell defines a retaining arm corresponding to the recess.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
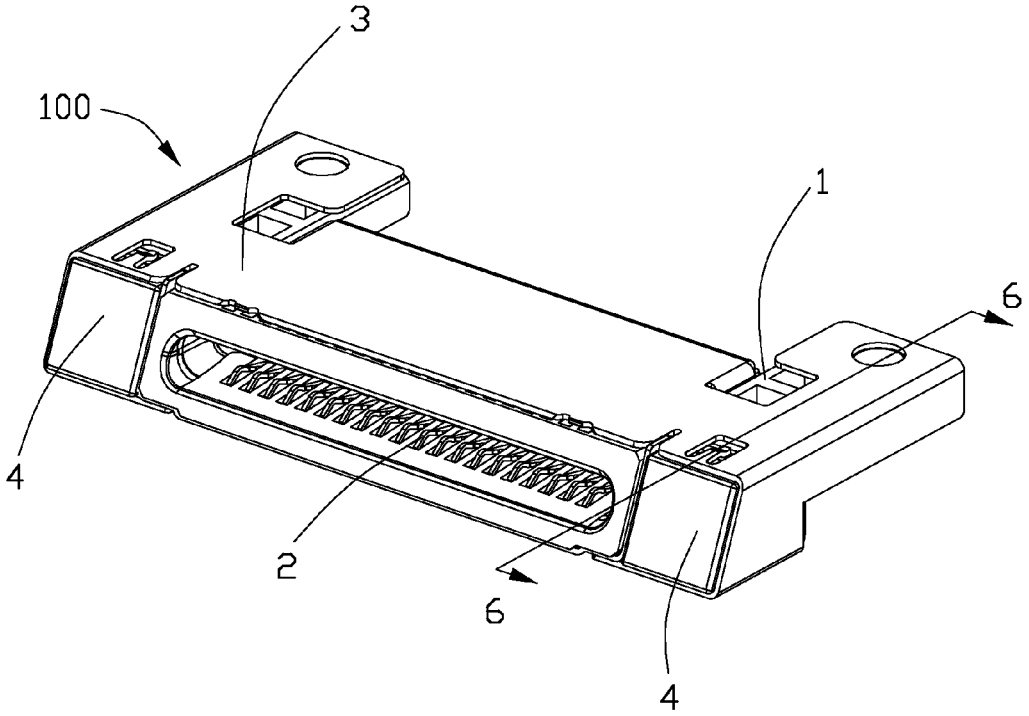
FIG. 1 is a perspective view of an electrical connector of the present invention.
Figure 2:
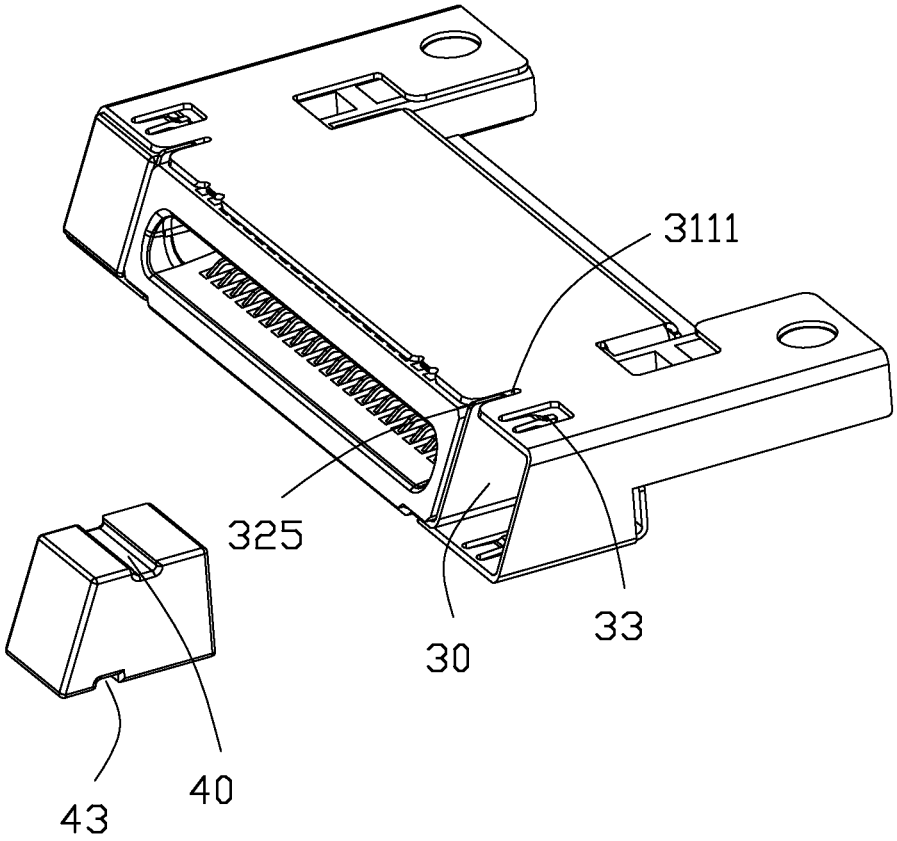
FIG. 2 is a part exploded perspective view of the electrical connector with a magnetic element un-mounted in the metal shell in FIG. 1.

Referring to FIG. 1 and FIG. 2, the present invention provides an electrical connector 100 comprising an insulative housing 1, a plurality of conductive terminals 2 secured in the insulative housing 1, a metal shell 3 shielding around the insulative housing 1 and at least a magnetic element 4 retained in the metal shell 3. The metal shell 3 forms an accommodating room 30 for receiving the magnetic element 4. The magnetic element 4 has an outer surface, and at least one recess 40 recessed on the outer surface thereof. There are two recesses 40 formed in the present embodiment, and there will be more than two recesses 40 in other embodiments to meet the demand. The metal shell 3 has some retaining arms 33 corresponding to the recesses 40.

Figure 3:
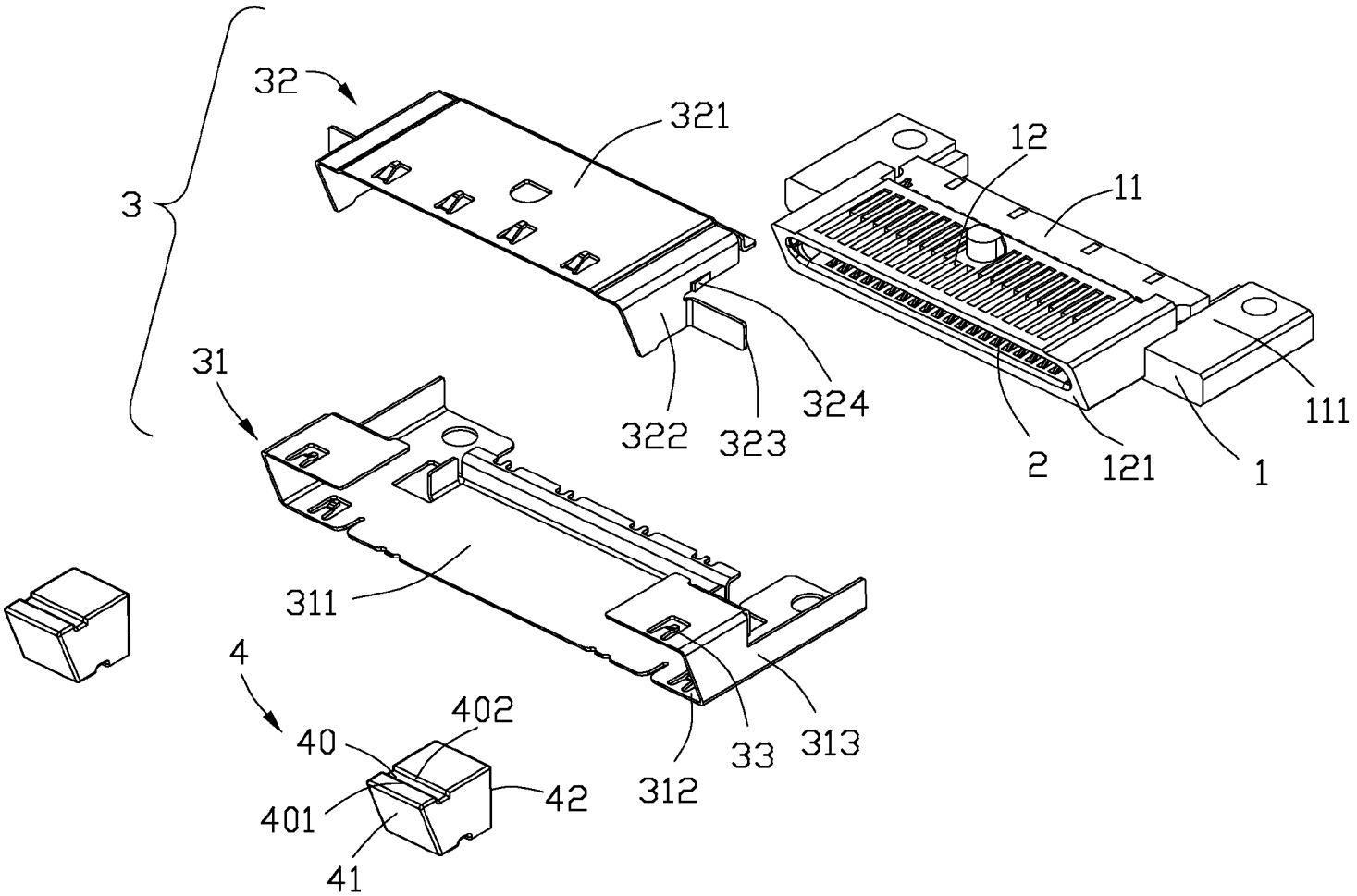
FIG. 3 is an exploded perspective view of the electrical connector in FIG. 1.
Figure 4:
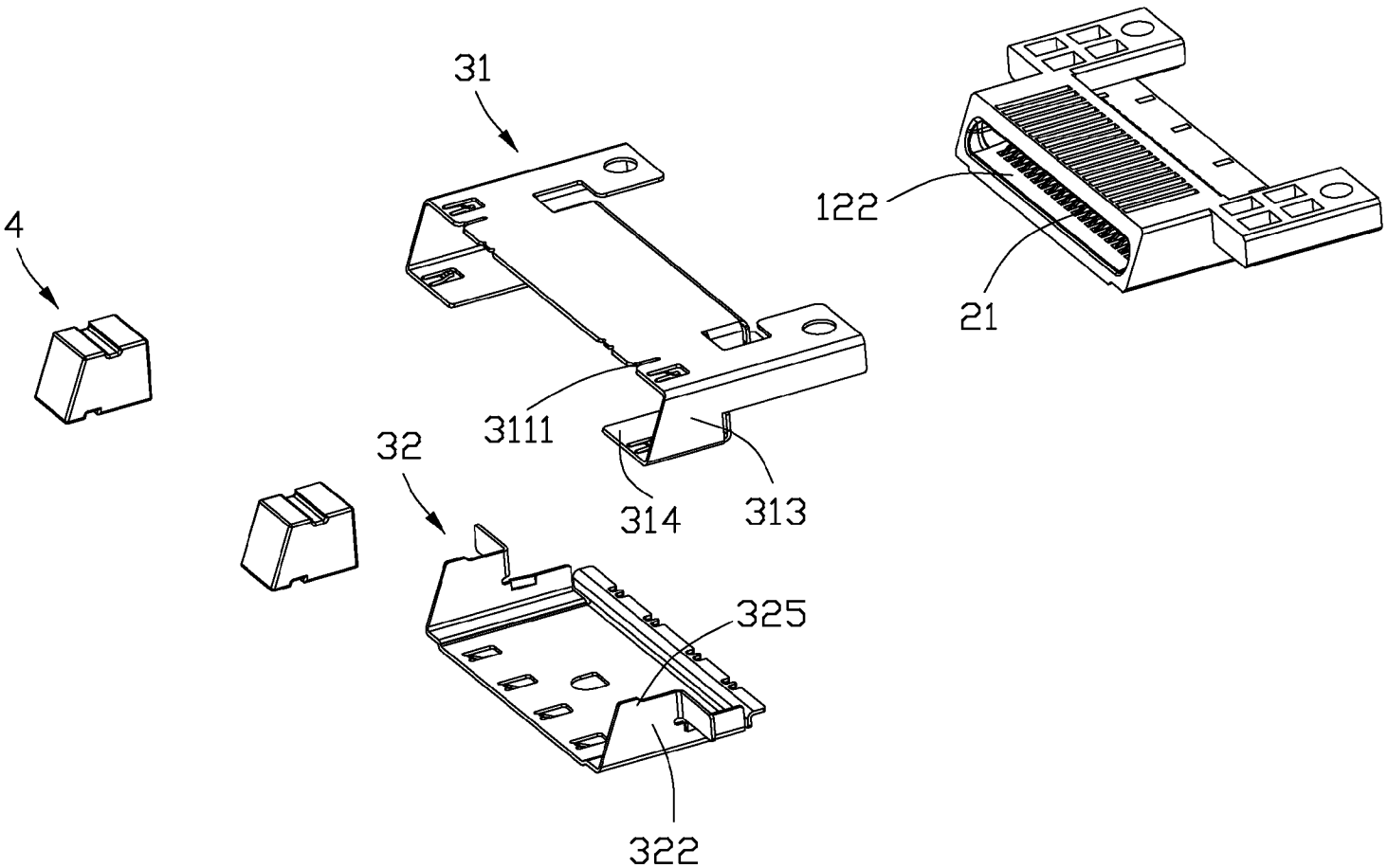
FIG. 4 is another exploded perspective view of the electrical connector in FIG. 1.

Referring to FIG. 3 and FIG. 4, the insulative housing 1 includes a base portion 11 and a mating portion 12 extending forwardly from the base portion 11. The mating portion 12 defines an upper wall (not labeled), a lower wall (not labeled) and two side walls (not labeled) connecting the upper wall with the lower wall. The four walls surround to form a mating cavity 122 positioned in front of the base portion 11. Part of the conductive terminals 2 exposed in the mating cavity 122. The mating portion 12 further defines a mating face 121 slanting to the upper wall and the lower wall. The mating cavity 122 aforementioned passes through the mating face 121. Each of the conductive terminals 2 includes a contact portion 21 protruding into the mating cavity 122. The base portion 11 defined a pair of enhanced portions 111 extending from two end sides of the base portion 11. The enhanced portion 111 extends initially outwardly and then extends rearward and forwardly to form a front region and a rear region, respectively. The front region of each enhanced portions 111 is positioned at two outer sides of the mating portion 12 and is also adjacent to the mating portion 12, and the rear region of each enhanced portions 111 extends rearward and is behind the base portion 11. The enhanced portion 111 is disposed behind and is probably adjacent to the magnetic element 4 so as to prevent the rearward over-movement of the magnetic element 4.

The metal shell 3 is used for reducing the electromagnetic interference of the conductive terminals 2 in the mating cavity 122 and attaches to the outer surface of the mating portion 12 and a part of the base portion 11. Notably, the metal shell 3 forms the two accommodating rooms 30 aforementioned, which is positioned at two outer sides of the mating portion 12 and in front of the enhanced portions 111.

In the present embodiment, the metal shell 3 includes a body portion (not labeled) attached to the mating portion 12 and four side walls forming the accommodating room 30. The enhanced portion 111 is located behind the accommodating room 30, and at least one of the four side walls is formed with a stop portion bending from a rear edge thereof. The stop portion is between the magnetic element 4 and the enhanced portion 111.

Figure 5:
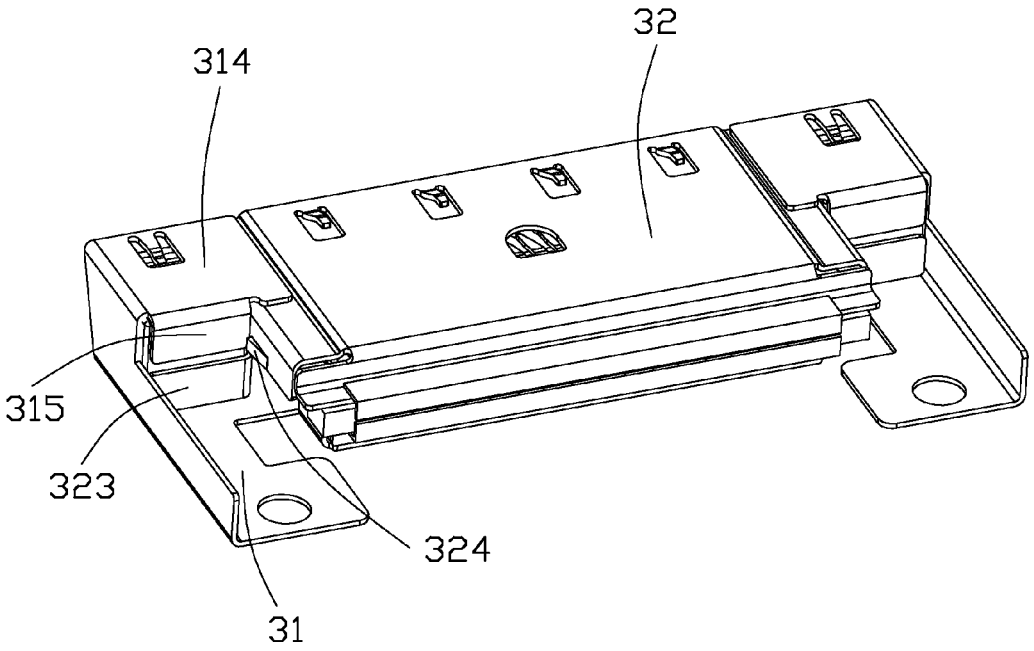
FIG. 5 is a perspective view of the electrical connector without an insulative housing and taken from back side in FIG. 1.

FIG. 5 will be combined to introduce the specific structure of the metal shell 3 in detail hereinafter. The metal shell 3 includes a first shell 31 and a second shell 32 assembled with each other. The first and second shells 31, 32 surround to form the two accommodating rooms 30 and a room (not labeled) which accommodates the mating potion 12. The room is between the accommodating rooms 30 along a longitudinal direction perpendicular to the front to rear direction, and these rooms are separated side by side by the second shell 32. Moreover, the first shell 31 includes a first body portion 311 attached to the lower surface of the insulative housing 1, two first side walls 312 extending outwardly from two opposite sides of the first body portion 311 along the longitudinal direction, two second side walls 313 bending from the first side walls 312 along a vertical direction perpendicular to the longitudinal direction and the front to back direction, and two third side walls 314 bending inwardly horizontally. The first side wall 312 and the third side wall 314 are opposite and parallel to each other. The second side wall 313 is perpendicular to the first and third side walls 312, 314.

The second shell 32 includes a second body portion 321 and two fourth side walls 322 bending downwardly from two opposite side ends of the second body portion 321 along the vertical direction. Each of the fourth side walls 322 is just opposite to the corresponding second side wall 313 after the two shells 31, 32 are assembled to each other. The first, second, third, and fourth side walls 312, 313, 314, 322 surround to form the accommodating rooms 30 approximately configured as rectangular.

The second shell 32 has two cantilever first stop portions 323 bending outwardly from the rear end of the fourth side walls 322. Each of first stop portions 323 is just behind the four side walls 312, 313, 314, 322. As illustrated in FIG. 5, the third side wall 314 has a second stop portion 315 bending from the rear edge thereof. The second stop portion 315 and the first stop portion 323 are roughly in the same plane. The fourth side wall 322 stamps outwardly to form a third stop portion 324. The third stop portion 324 configured as cantilever is adjacent to a rear face of the second stop portion 315. The first and second stop portion 323, 315 disposed between the magnetic element 4 and the enhanced portion 111. In the present embodiment, the third stop portion 324 and the enhanced portion 111 will provide strength to the first and second stop portions 323, 315 when the electrical connector 100 mating with the complementary connector. Besides, two side regions along the longitudinal of the second body portion 321 are slightly lower than a middle region thereof, thereby forming two step portions used for placing the third side walls 314 after the second shell 32 assembled in to the first shell 31 from a back to front direction perpendicular to the longitudinal direction.

Referring to FIG. 2 and FIG. 4, each of the fourth side walls 322 defines a latch potion 325 at a lower edge thereof. The first body portion 311 defines two through openings 3111. The latch portions 325 are inserted into the openings 3111 for securing the first and the second shell 31, 32.

The metal shell 3 surrounds the mating portion 12, and defines the two accommodating rooms 30 opening forwardly and disposed at two opposite outer sides of the mating portion 12. The magnetic element 4 is assembled into the accommodating room 30 along a front to back direction. Combined to FIG. 1, the electrical connector 100 has two magnetic elements 4 respectively received in the two accommodating rooms 30. The magnetic element 4 defines a front side surface 41, a rear side surface 42 opposite to the front side surface 41, and side wall surfaces connecting the front side surface 41 with the rear side surface 42 at the outer surface thereof. The front side surface 41 is exposed out of the metal shell 3 and aligned to the mating face 121, and the rear side surface 42 is adjacent to the metal shell 3. At least one of the side wall surfaces defines the recess 40 described aforementioned. Combined to FIG. 6, the recess 40 has a first inner edge 401, a second inner edge 402 opposite to the first inner edge 401 along a front to back direction and an inner surface 403 recessed from the magnetic element 4 and connecting the first inner edge 401 with the second inner edge 402. Part of the inner surface 403 is recessed inwardly and rearward from the second inner edge 402 along a front to back direction. The retaining arm 33 is configured as cantilever and extends rearward into the recess 40. In the present embodiment, the recess 40 runs through the side wall surfaces of the magnetic element 4 along the longitudinal orientation. Certainly, the specific structure of the recess 40 can be designed in any other configurations according to actually demands.

Figure 6:
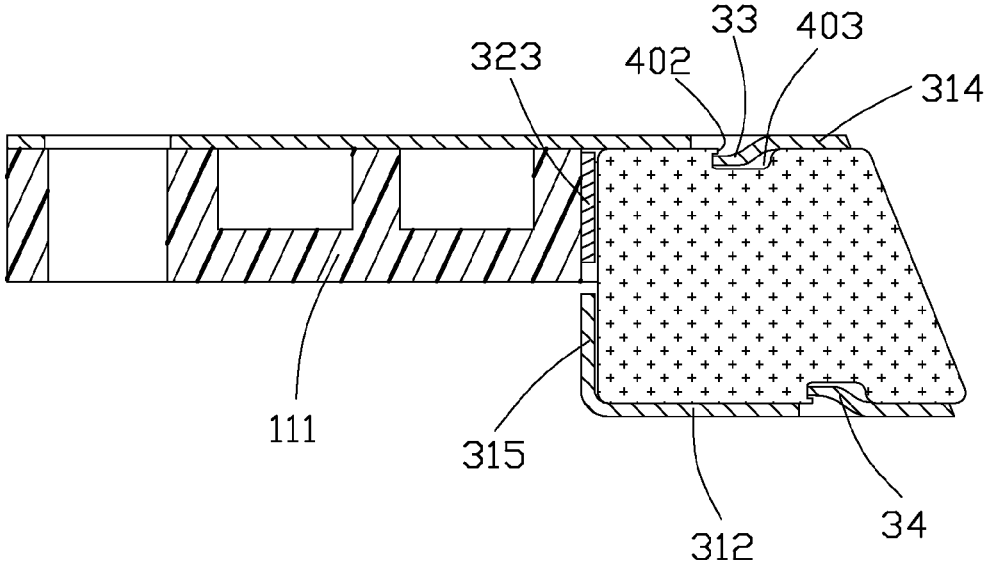
FIG. 6 is a cross sectional view of the electrical connector along line 6-6 in FIG. 1.

Referring to FIG. 2 and FIG. 6, the inner surface 403 is recessed inwardly from the second inner edge 402. The retaining arm 33 of the metal shell 3 configured as fingerlike is stamped inwarly from one of the side walls 312, 313, 314, 322. The retaining arm 33 protrudes into the inner surface 403 of the recess 40, and a front side portion of the retaining arm 33 is positioned below the second inner edge 402, thereby the magnetic element 4 is able to make a restriction on the retaining arm 33 in a vertical direction perpendicular to the longitudinal direction and the front to back direction so as to prevent the retaining arm 33 from coming out therefrom. The design of the magnetic element 4 make it has a better retaining force. In the best embodiment, the recess 40 is defined at the third side wall 314, and the magnetic element 4 defines another recess 43 at a side surface opposite to the side surface which defined the recess 40. That is to say, two opposite side surfaces of the magnetic element 4 separately define the recess 40, 43. The first side wall 312 stamped another retaining arm 34 corresponding to the recess 43. The structure of the recess 43 is simple, and also can be designed as the structure of the recess 40.

In conclusion, the magnetic element 4 defines two recesses 40, 43 at the outer surface thereof, and the metal shell 3 defines two retaining arms 33, 34 corresponding to the recesses 40, 43. Compared to general assembly, the assembly of the magnetic element 4 in to the electrical connector 100 is more convenient and efficiency.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing;

a plurality of conductive terminals secured in the insulative housing;

a metal shell shielding around the insulative housing and forming an accommodating room; and a magnetic element retained in the accommodating room of the metal shell and having an outer surface;

wherein the magnetic element defines a recess at the outer surface, and the metal shell has a retaining arm corresponding to the recess and latching with the recess.

2. The electrical connector as claimed in claim 1, wherein the magnetic element defines two said recesses at two opposite side surfaces of the outer surfaces thereof, and the metal shell has two said retaining arms engaging with the two recesses, respectively.

3. The electrical connector as claimed in claim 1, wherein the insulative housing includes a base portion and a mating portion extending forwardly from the base portion, the metal shell surrounds the mating portion and forms two said accommodating rooms aforementioned which open forwardly at two opposite sides of the mating portion, and two magnetic elements aforementioned are assembled into the accommodating rooms along a front to back direction.

4. The electrical connector as claimed in claim 3, wherein the recess includes a first inner edge, a second inner edge opposite to the first inner edge along the front to back direction, and an inner surface connecting the first inner edge with the second inner edge, a part region of the inner surface is recessed inwardly from the second inner edge in the front to back direction, the retaining arm is configured as fingerlike and rearward inserts into the recess from the metal shell.

5. The electrical connector as claimed in claim 3, wherein the metal shell has a body portion attached to the mating portion and four side walls surrounding to form the accommodating rooms, and the insulative housing has two enhanced portions separately behind the two accommodating rooms.

6. The electrical connector as claimed in claim 5, wherein at least one of the four side walls is formed with a stop portion bending from a rear edge thereof, and the stop portion is positioned between the magnetic element and the enhanced portion.

7. The electrical connector as claimed in claim 5, wherein the metal shell has a first shell and a second shell assembled with each other, the first and second shells surround to form the accommodating rooms.

8. The electrical connector as claimed in claim 7, wherein the first shell has a first body portion, two first side walls extending horizontally and outwardly from two sides of the first body portion, two second side walls separately bending from the first side walls in a vertical direction perpendicular to the front to back direction and two third side walls separately bending inwardly and extending horizontally from the second side walls, the second shell has a second body portion and two fourth side walls bending from the two opposite sides of the second body portion in a vertical direction, the first, second, third and fourth side walls surround to form said accommodating room.

9. The electrical connector as claimed in claim 8, wherein the second shell defines a cantilever first stop portion bending outwardly from a rear edge of the fourth side wall, the first shell bends a second stop portion from a rear edge of the third side wall, the first and second stop portions are both positioned between the magnetic element and the enhanced portion and in a same plane.

10. The electrical connector as claimed in claim 9, wherein the fourth side wall stamped outwardly to form a third stop portion, and the third stop portion is configured as cantilever and is adjacent to a rear face of the second stop portion.

11. An electrical connector, comprising:

an insulative housing including a base portion and a mating portion extending forwardly from the base portion;

a plurality of conductive terminals retained in the insulative housing;

a metal shell shielding around insulative housing, the metal shell including a first shell and a second shell assembled with each other; and a pair of magnetic elements received in the metal shell;

wherein the first and second shells surround to form a mating room and two accommodating rooms disposed at two sides of the mating room along a longitudinal direction, the three rooms are separated side by side by the second shell, the mating portion of the insulative housing is received in the mating room, and each of the magnetic elements is secured in the accommodating room by a pair of retaining structures.

12. The electrical connector as claimed in claim 11, wherein each of the magnetic elements has an outer surface, the magnetic element defines a recess recessed at the outer surface, and the metal shell defines a retaining arm engaging with the recess.

13. The electrical connector as claimed in claim 12, wherein the first shell has a first body portion and three side walls extending outwardly one by one from the first body portion, the second shell includes a second body portion and a side wall bending from the second body portion vertically, the first and second body portion and the side wall of the second shell surround to form the mating room, the four side walls of the first and second shells surround to form the accommodating room.

14. The electrical connector as claimed in claim 13, wherein each of the magnetic element has an upper surface and a lower surface opposite to the upper surface, the upper and lower surfaces both define the recess aforementioned, and the two side walls opposite to each other of the first shell has the retaining arms configured as cantilever and extending into the recesses.

15. An electrical connector comprising:

an elongated insulative housing extending along a lengthwise direction and defining a mating port exposed forwardly toward an exterior along a front-to-back direction perpendicular to said lengthwise direction, and located behind a front face lying in a plane oblique to said front-to-back direction;

a plurality of contacts disposed in the housing with contacting sections exposed in the mating port;

a metallic shell enclosing said housing with an opening exposing said mating port forwardly; and a pair of magnets located by two opposite ends of the mating port in said lengthwise direction; wherein each of said magnets forms a front surface parallel to said front face.

16. The electrical connector as claimed in claim 15, wherein said front surface is coplanar with said front face.

17. The electrical connector as claimed in claim 15, wherein the shell forms a pair of accommodating rooms by two opposite ends of the mating port in the lengthwise direction to receive said pair of magnets therein, respectively.

18. The electrical connector as claimed in claim 17, wherein said pair of accommodating rooms are configured to have the corresponding magnets rearwardly assembled thereinto along said front-to-back direction, respectively.

19. The electrical connector as claimed in claim 18, wherein the shell forms resilient arms extending into recesses of the corresponding magnets, respectively, to secure the corresponding magnets in position.

20. The electrical connector as claimed in claim 19, wherein said recess extends through the corresponding magnet along said lengthwise direction.

* * * * *